US009936778B2

(12) United States Patent
Holland

(10) Patent No.: US 9,936,778 B2
(45) Date of Patent: Apr. 10, 2018

(54) LUGCOT

(71) Applicant: Billy Holland, Huntsville, AL (US)

(72) Inventor: Billy Holland, Huntsville, AL (US)

( * ) Notice: Subject to any disclaimer, the term of this patent is extended or adjusted under 35 U.S.C. 154(b) by 0 days.

(21) Appl. No.: 15/330,096

(22) Filed: Aug. 4, 2016

(65) Prior Publication Data

US 2017/0332754 A1 Nov. 23, 2017

Related U.S. Application Data

(60) Provisional application No. 62/282,701, filed on Aug. 10, 2015.

(51) Int. Cl.

| | |
|---|---|
| ***A45C 9/00*** | (2006.01) |
| ***A45C 5/03*** | (2006.01) |
| ***A45C 13/00*** | (2006.01) |
| ***A45C 13/26*** | (2006.01) |

(52) U.S. Cl.

CPC ..... *A45C 5/03* (2013.01); *A45C 9/00* (2013.01); *A45C 13/001* (2013.01); *A45C 13/26* (2013.01)

(58) Field of Classification Search

CPC .... A45C 9/00; A45C 3/00; A45C 5/00; A45C 5/03; A45C 7/00

USPC ..... 190/2, 18

See application file for complete search history.

(56) References Cited

U.S. PATENT DOCUMENTS 1,281,385 A * 10/1918 Johnson ..... A61G 1/01 5/187
1,608,924 A * 11/1926 Brown ..... A47B 3/02 108/118
1,696,245 A * 12/1928 Manly ..... A47C 17/72 135/909
D129,880 S * 10/1941 Mattes ..... D2/793
3,703,181 A * 11/1972 Tholen ..... E04H 15/06 135/137
3,841,727 A * 10/1974 Peng ..... A47B 47/0091 190/11
D350,613 S * 9/1994 Fahy, Jr. ..... D25/138
5,562,236 A * 10/1996 Monzingo ..... A45C 7/0086 224/153
D419,783 S * 2/2000 Tavenas ..... D5/59
D438,381 S * 3/2001 Sijmons ..... D3/276
D454,430 S * 3/2002 Sijmons ..... D3/279
6,581,736 B1 * 6/2003 Scicluna ..... A45C 13/40 150/106
2006/0207849 A1 * 9/2006 Sadow ..... A45C 7/0081 190/18 A
2009/0289480 A1 * 11/2009 McFarland ..... A45C 13/262 297/255
2010/0236884 A1 * 9/2010 Brown ..... A45C 9/00 190/11
2011/0000017 A1 * 1/2011 Peterson ..... A47C 17/72 5/111
2011/0023232 A1 * 2/2011 Sun ..... A47C 17/72 5/111
2011/0056788 A1 * 3/2011 Jackson ..... A45B 23/00 190/2
2013/0256072 A1 * 10/2013 Farhat ..... A47C 4/52 190/2
2014/0205737 A1 * 7/2014 Strecker ..... A23D 7/011 426/611

(Continued)

*Primary Examiner* — Albert K Wong

(57) ABSTRACT

The present suitcases only provide the service of carrying clothing and cosmetics. This Invention would carry clothing, cosmetics and bed.

3 Claims, 4 Drawing Sheets

(56) References Cited

U.S. PATENT DOCUMENTS

| | | | | |
|---|---|---|---|---|
| 2014/0326558 | A1* | 11/2014 | Marti | A45C 9/00 190/2 |
| 2017/0020253 | A1* | 1/2017 | Drozdowicz | A45C 9/00 |
| 2017/0081445 | A1* | 3/2017 | Chai | B29C 47/0026 |

* cited by examiner

Main Body

LUGCOT

CROSS REFERENCE TO RELATED APPLICATIONS

| | | |
|---|---|---|
| D129880 | August 1941 | Hafner |
| D350613 | September 1994 | Fahy, Jr. |
| D419783 | February 2000 | Tavenas |
| D438381 | March 2001 | Sijmons |
| 1281385 | October 1918 | Johnson |
| 6581736 | June 2003 | Scicluna |
| 1608924 | November 1926 | Brown |
| 1696245 | December 1928 | Manley |
| 2010/0205737 | August 2010 | Peterson |
| 2011/0000017 | January 2011 | Peterson |
| 2011/0023232 | February 2011 | Sun |
| D454430 | March 2002 | Sijmons |

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

In accordance with an embodiment of the present Invention relates to a modified suitcase incorporating a compartment from which would extend a lightweight telescopic cot. There is a suitcase with a built in collapsible cot structure in the back comprising a fabric Web, a frame, and folding legs. When set up, the cot structure provides for a person to lie down or sit on top of the fabric. There is a divider, where divider separates the luggage first compartment and cot in second compartment in one particular embodiment. The lugcot modification would ensure a place to set or sleep, was always available and the traveler did not have to rest upon the floor or ground. Not only will present invention benefit traveler, it will benefit camper for backpacks, military backpacks, forest fire fighter's backpacks.

The present suitcases only provide the service of carrying clothing and cosmetics. This Invention would carry clothing, cosmetics and bed.

BRIEF SUMMARY OF THE INVENTION

The Invention a modified suitcase would incorporate a compartment from which would extend a lightweight Cot. The design of his article of luggage would ensure the individual luggage was always attended as the cot would be secured to the base of the luggage. Thus, it would eliminate the luggage from being stolen. In this sense, this invention would provide travelers with enhanced safety and peace of mind.

DETAILED DESCRIPTION OF THE INVENTION

The present invention relates to a travel luggage with a telescopic Cot extendable therefrom. The present invention provides travel Luggage that includes two compartments. One compartment is provided for the placement of clothing, toiletries and other travel accessories and a second compartment is provided where a telescopic Cot is stored. The present invention allows for the extension of a Telescopic Cot from the back of the Luggage. This Luggage along with Cot provides a means for a Traveler to create a bed to relax during an extended lay-over at an airport, or on a hiking or camping trip, when visiting relatives, for military backpacks when wrist is needed and for forest fire fighters.

Figure 1:
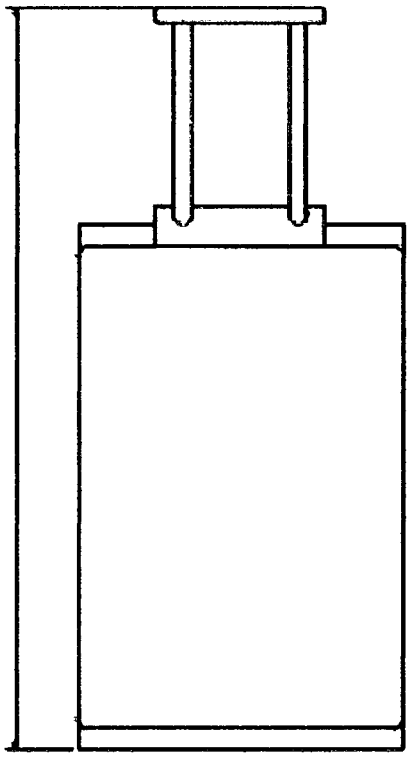
FIG. 1 Back of luggage
FIG. 2 Side of luggage
FIG. 3 Angle of Luggage
FIG. 4 LUGCOT wheels and material not shown
Figure 2:
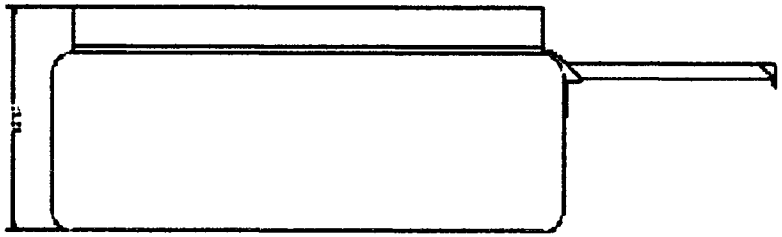
Figure 3:
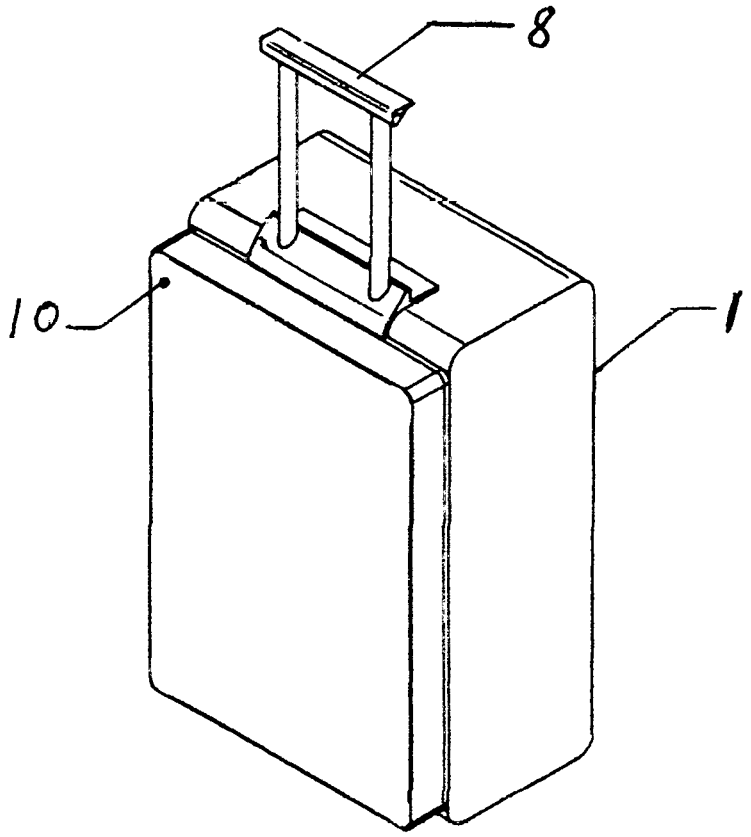
Figure 4:
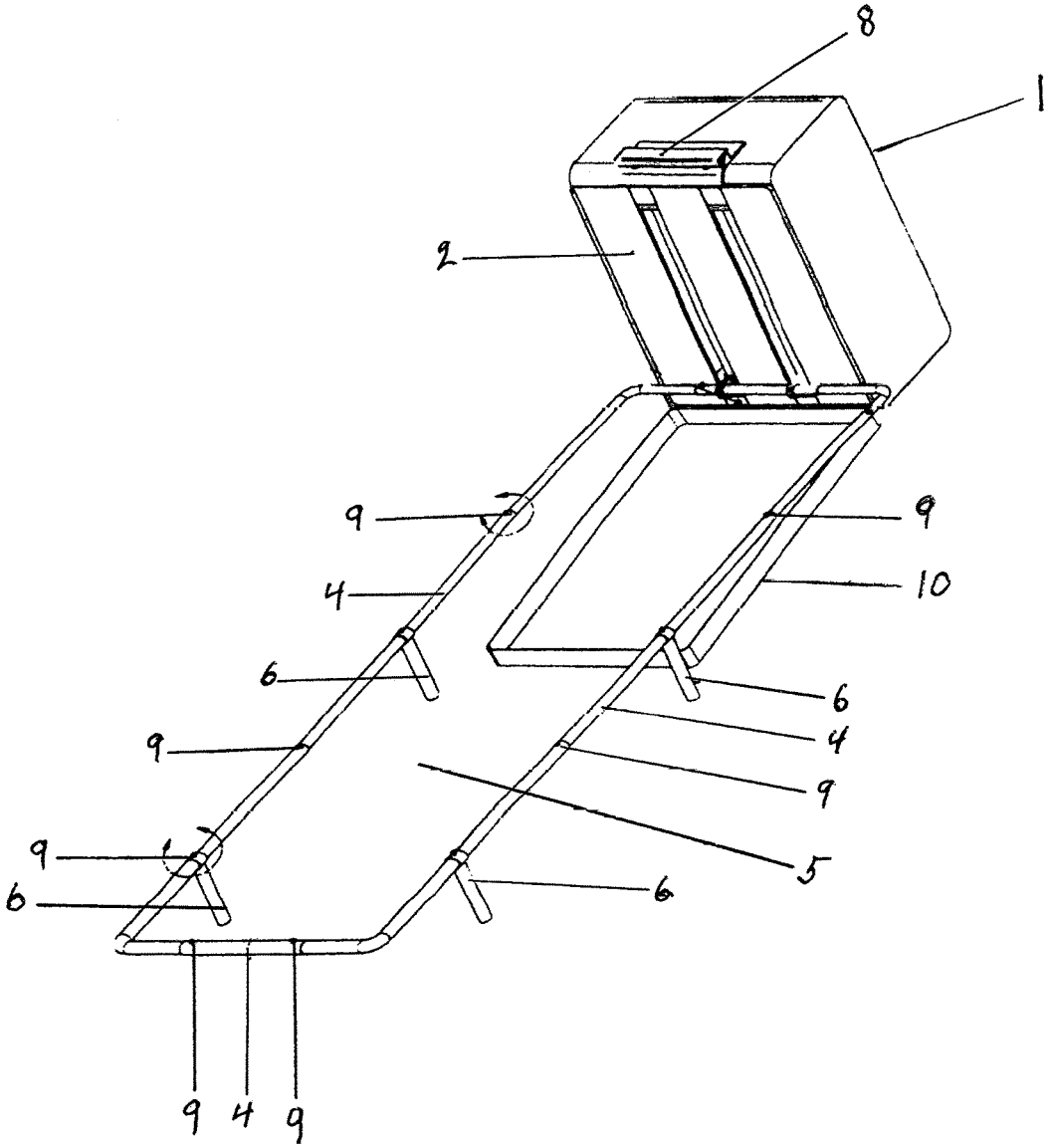

In reference to FIG. 1A, a perspective view of a Travel Luggage 6 views is depicted. The travel luggage includes a Main Body 3, with a First Side 2. As shown in FIG. 1, the back view Side 1, the back angle view 4, opens and allows the extension of a Cot 5, for use by the owner. The Cot 5, extends from a Compartment 1, as shown in FIG. 1 of the Luggage 4. In addition to the First first 1, the Luggage 1 also includes a Second Compartment also shown in FIG. 1. When in a closed position the Luggage 1 is similar to any other respective travel luggage that is used on the market. Travel Luggage 1 according to the present invention includes two compartments, one for storing clothing and other travel accessories in Second Compartment 7 and the First Compartment 6 for the storage of an Cot.

In reference to FIG. 1B, a perspective view of a Travel Luggage, 8 views is depicted, 1Locking Pin and Cot and frame of Cot. FIG. 1B a Perspective view shows the Cot being set up in a matter of minutes.

In reference to FIG. 1C a perspective view of a Travel Luggage, view 8, Locking Pin.

The invention claimed is:

1. A travel luggage, comprising:

a main body having a height, width, and a depth wherein the main body defines a first compartment;

a handle extending substantially along the height of the main body and attached to the back side of the main body;

a second compartment, attached to the back side of the main body and having a similar height and width as the main body, that encloses the handle and includes a pivotally attached door that is attached near the bottom of the main body; and a cot frame pivotally attached to the bottom of the end of the handle that is contained within the second compartment wherein the cot frame has a covering.

2. The travel luggage in claim 1, wherein the cot frame includes a telescoped portion to enlarge the cot.

3. The travel luggage in claim 1, further comprising a plurality of legs attached to the cot frame to support the cot.

* * * * *